US006073822A

United States Patent [19]

Swensen de Vidals

[11] Patent Number: 6,073,822

[45] Date of Patent: Jun. 13, 2000

[54] KNAPSACK WITH RIGID, SOLID MEMBER SUCH AS A HUBCAP

[75] Inventor: Danielle Swensen de Vidals, Brooklyn, N.Y.

[73] Assignee: Aaron Schwartz, Fair Lawn, N.J.

[21] Appl. No.: 09/239,197

[22] Filed: Jan. 28, 1999

[51] Int. Cl.[7] ..... A45F 3/04

[52] U.S. Cl. ..... 224/629; 224/153; 224/627

[58] Field of Search ..... 224/629, 628, 224/640, 153, 201, FOR 209, FOR 210; D3/216, 217; 301/168.1; 150/103, 104, 105

[56] References Cited

U.S. PATENT DOCUMENTS

D. 359,847 7/1995 Callegari ..... D3/217
2,152,253 3/1939 Greene, Sr. ..... 301/108.1
3,902,640 9/1975 Geiben ..... 224/629
4,088,252 5/1978 Grumberger ..... 224/629
5,911,348 6/1999 Shook ..... 224/629

*Primary Examiner*—Allan N. Shoap
*Assistant Examiner*—Maerena W. Brevard
*Attorney, Agent, or Firm*—Brian Roffe

[57] ABSTRACT

A knapsack including a selectively accessible compartment defined in part between a rigid, substantially solid member and a panel in opposed relationship thereto. The rigid member or panel includes straps for enabling attachment to a wearer. The rigid member is preferably a hubcap in which case, a circular ring is attached to an inner side thereof and another panel extends over the ring.

18 Claims, 1 Drawing Sheet

KNAPSACK WITH RIGID, SOLID MEMBER SUCH AS A HUBCAP

FIELD OF THE INVENTION

The present invention relates generally to a knapsack having a rigid, solid member to provide some rigidity to the knapsack and more particularly, to a knapsack incorporating a hubcap of the type placed on automotive or vehicular tires.

BACKGROUND OF THE INVENTION

Knapsacks are usually made of a number of panels of fabric material stitched together to define a compartment receivable of articles and a zipper stitched to the fabric panels to enable access to the compartment. Thin, bendable plastic material is also often used instead of fabric. Knapsacks made solely of fabric or thin plastic material do not provide any rigidity to the knapsack, which lack of rigidity may result in damage to articles carried in the compartment thereof.

In the prior art, there are hiking or camping backpacks which include an assembly of hollow pipes forming a grid over which fabric panels are stretched. Although such backpacks provide some overall rigidity and likely prevent some articles contained therein from being damaged, the presence of the fabric panels extending between the pipes does not prevent all damage as an object may impact the backpack in an area of such a panel.

In order to distinguish one knapsack from another, and to increase the allure of a particular knapsack, the front panel of the knapsack, i.e., that panel facing outward away from the person wearing the knapsack, is often decorated with a distinctive design, e.g., with popular children's characters, a motif from movies or sports motifs.

OBJECTS AND SUMMARY OF THE INVENTION

It is an object of the invention to provide a new and improved knapsack.

It is another object of the present invention to provide a new and improved knapsack which has some degree of rigidity to thereby prevent damage to articles placed in the compartment defined in the knapsack.

It is yet another object of the present invention to provide a new and improved knapsack with a distinctive front panel to increase the allure of the knapsack.

In order to achieve these objects, and others, the knapsack in accordance with the invention includes compartment-defining means for defining a selectively accessible compartment and attachment means for enabling attachment of the compartment-defining means to a wearer of the knapsack. To provide the advantages of the invention discussed above, the compartment-defining means comprise a rigid, substantially solid member, such as a hubcap. When used to describe the member in the knapsack herein, rigid means stiff and not bendable and solid means having a definite shape. The rigid member may be made of any suitable material including, but not limited to, hard plastics, metal, wood or combinations thereof. Also, the solid member may be apertured to a limited extent.

The compartment-defining means may include an additional panel coupled to and spaced from the rigid member to thereby define the compartment between the rigid member and the additional panel. Preferably, the rigid member constitutes a front panel of the knapsack, i.e., that panel which faces outward away from the wearer, and the additional panel constitutes a rear panel of the knapsack adapted to be situated adjacent the wearer's back. One or more side panels extend between the front and rear panels to thereby define the closeable compartment between the front, rear and side panels and at least one of side panels includes means for enabling access to the compartment, e.g., a zipper. The side panel(s) may be directly connected to the front and rear panels, e.g., by heat-bonding, adhesive, stitching, or by any other permanent or temporary connecting means.

The shape of the rigid member may be circular, square, rectangular or any other shape. It may also include apertures or perforations, preferably while maintaining its overall shape. Similarly, the shape of the rear panel may be circular, square, rectangular or any other shape and does not have to be the same shape as the rigid member. The number of side panels is selected to adequately seal the compartment defined between the rigid member and the rear panel. In the case that the rigid member is a generally circular hubcap, the rear panel may also be circular so that a single tubular side panel may be provided connecting the hubcap to the rear panel.

In the event that the rigid member is a hubcap that does not provide a interior surface for defining the compartment, a circular ring may be attached to an inner side of the hubcap and a panel is arranged on the ring to thereby provide a suitable surface for defining the compartment. In this case, the compartment into which articles may be placed is defined between the rear panel and the panel arranged on the ring. The panel arranged on the ring may be solid or apertured so long as an adequate surface is provided to retain articles in the compartment. The panel arranged on the ring is preferably solid and extends across the entire ring, i.e., circular. The side panel(s) may be connected to either the hubcap itself, e.g., by heat-bonding, adhesive, or by any other permanent or temporary connecting means, or in the alternative, may be connected to the ring or panel arranged thereon.

The attachment means may be any conventional attachment means for attaching the compartment-defining portion of a knapsack to a wearer. In one particular implementation, the attachment means comprise a pair of straps, each having a first end connected at an upper location on the compartment-defining means and a second end connected at a respective lower location on the compartment-defining means. Preferably, the first and second ends of each strap are secured to the rigid member. The straps may be tied to the rigid member, bonded thereto, adhered thereto by adhesive, stitched thereto or manufactured in connection therewith. If the rigid member is a hubcap, which usually has a design including apertures, the straps may be tied through the apertures.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
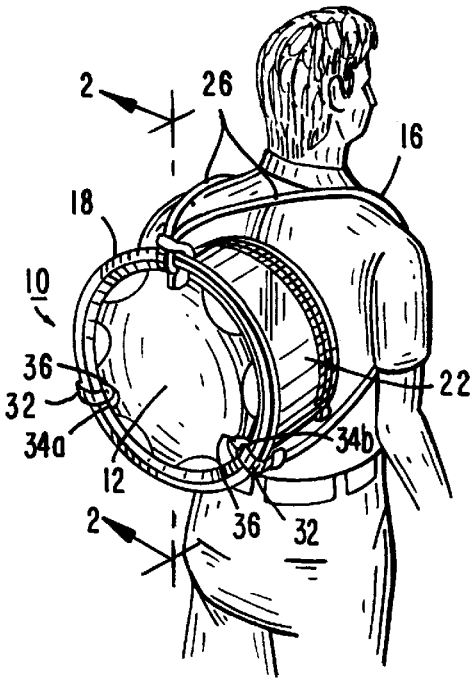
FIG. 1 is a rear view of a knapsack in accordance with the invention when situated on a wearer's back.
Figure 2:
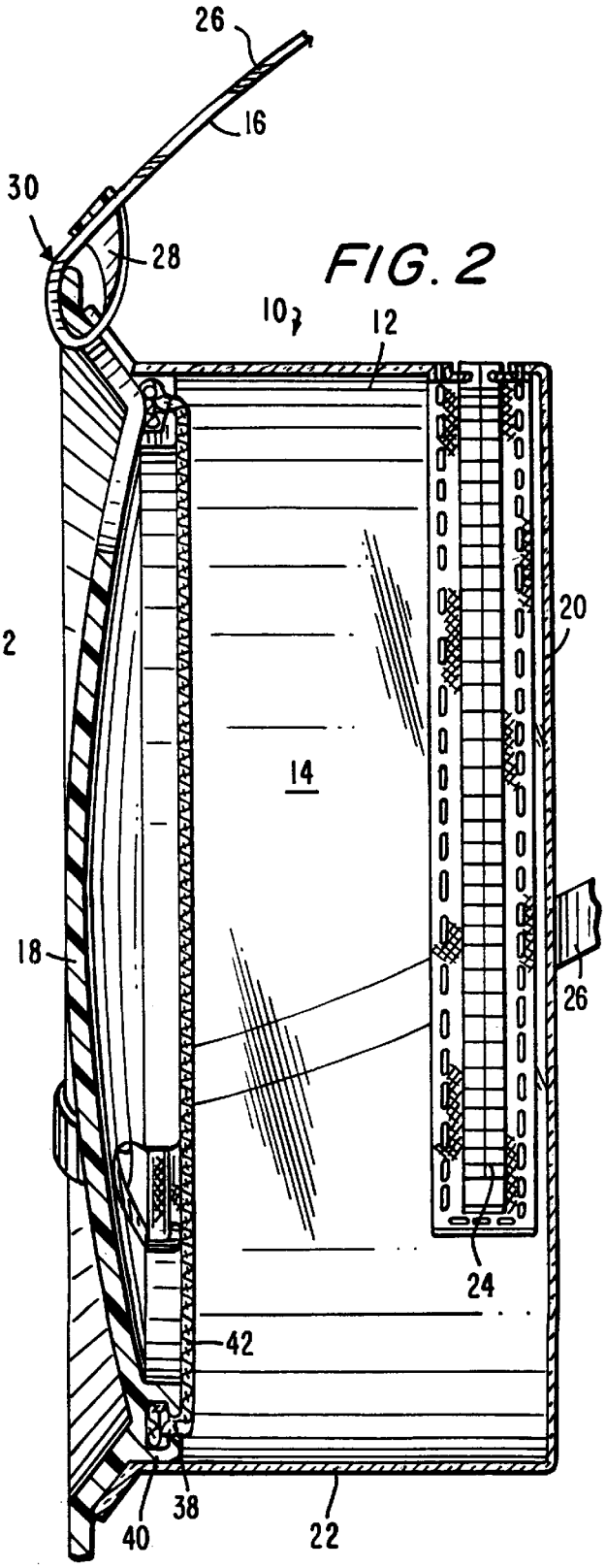
FIG. 2 is a cross-sectional view taken along the line 2—2 of FIG. 1.
Figure 3:
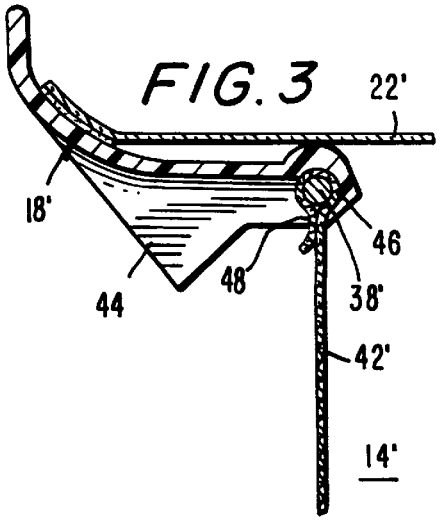
FIG. 3 is a partial view of an alternative attachment of the hubcap to the knapsack.

Referring to FIGS. 1–3 wherein like reference numerals refer to the same or similar elements, a knapsack in accordance with the invention is generally designated as 10 and includes compartment-defining means 12 defining a compartment 14 and attachment means 16 for enabling attachment the compartment-defining means 12 to a wearer of the knapsack 10. The compartment-defining means 12 comprise a rigid, substantially solid member such as a generally circular hubcap 18 which constitutes the front panel of the knapsack 10. As defined herein, the front panel is that panel which faces outward away from the wearer. Further, the compartment-defining means 12 include a panel 20 in opposed relationship to and spaced from the hubcap 18 and another panel 22 extending between the hubcap 18 and the panel 20. The compartment 14 is defined between the hubcap 18 and panels 20,22. Panel 20 constitutes a rear panel of the knapsack 10, i.e., it is adapted to be positioned directly against the wearer's back whereas panel 22 constitutes a side panel of the knapsack 10.

To enable access to compartment 14, a zipper 24 is provided in the side panel 22 in a conventional manner. As an alternative to the zipper 24, any other means which selectively enable access to the compartment 14 and enable the compartment 14 to be closed may be provided, e.g., Velcro™ strips, snaps, buttons and the like. Further, the zipper 24 or equivalent access-enabling means may be situated in any of the elements or members defining the compartment 14. For example, if desired, a zipper may be placed in rear panel 22 if so desired.

As shown in FIG. 1, the rear panel 20 is substantially circular in correspondence with the generally circular shape of the hubcap 18 and the side panel 22 is a tubular panel. Other shapes for the rear panel 20, as well as a plurality of side panels may also be provided in a knapsack in accordance with the invention without deviating from the scope and spirit thereof.

In the illustrated embodiment wherein the rigid member of the knapsack 10 is a hubcap 18, the hubcap 18 often does not include a suitable inner surface for defining the compartment 14. Therefore, one or more cooperating members 38 are provided to engage the connecting member(s) of the hubcap 18, i.e., the element(s) or member(s) which enable the hubcap 18 to be attached to a tire or wheel rim. The cooperating members 38 therefore takes the form of the minimum necessary structure to connect to the hubcap 18 and enable a suitable surface for the compartment to be provided. For the hubcap 18 in FIGS. 1 and 2 which includes a plurality of clips 40 spaced around the periphery thereof, the cooperating member 38 is a circular ring having a circular cross-sectional shape and which is adapted to be secured by the clips 40. The ring 38 is made of metal and engages with all of the clips 40. A panel 42 is arranged on the ring 38, e.g., a solid, fabric panel stitched around the ring 38. The panel 42 supported by the ring 38 thus provides a suitable surface to define the compartment 14. It should be understood though that different hubcaps may require different cooperating members and the invention is not limited to the use of a circular ring to engage with the clips of the hubcap in the illustrated embodiment.

Although only one compartment 14 is defined between rear panel 20 and panel 42, if desired, the knapsack 10 may be provided with additional compartments and panels defining the same. For example, it may desirable to include a panel interposed between the panels 20 and 42 to thereby partition compartment 14 into two separate compartments. Pockets may also be provided in any of the panels 20,22,42. In general, any other features present on conventional knapsacks may be incorporated into the knapsack in accordance with the invention.

The attachment means 16 comprise a pair of straps 26, each having a first end 28 connected at an upper location 30 to the hubcap 18 and a second end 32 connected at a respective lower location 34*a*,34*b* to the hubcap 18. More specifically, the hubcap 18 is usually provided with apertures 36 therein. As such, each end of the straps 26 may be looped through a respective one of the apertures 36 and tied to the hubcap 18. Instead of two straps 26, a single strap may be provided.

In a preferred implementation, the rear panel 20 and side panel 22 are made of plastic. The panel 40 arranged on the ring 38 is solid and is made of fabric. Further, the side panel 22 is a single sheet and is heat-bonded to inner surfaces of the hubcap 18 and stitched or heat-bonded around its periphery to the rear panel 20. The hubcap 18 is a standard hubcap made of a light plastic material.

Another possible manner in which the knapsack 10 is formed in connection with a hubcap is shown in FIG. 3 (wherein the same elements as in the embodiment of FIG. 2 are designated prime). In this embodiment, the ring 38' is retained by inwardly oriented projections 44 arranged around the circumference of the hubcap 18'. In normal use of the hubcap, these projections 44 serve to attach the hubcap 18' to a circular component of the wheel or tire rim. Projections 44 are thus formed integral with the remainder of the hubcap 18'. Each projection 44 includes an over clamp 46 and a pair of underlying fingers 48, one on each side of the clamp 46 (only one of which is shown in FIG. 3). To secure the ring 38' to the hubcap 18' during manufacture of the knapsack, the ring 38' is pressed into a groove defined between the clamp 46 and fingers 48 of each projection 44. The ring 38' is thus securely retained in connection with the hubcap 18'.

The examples provided above are not meant to be exclusive. Many other variations of the present invention would be obvious to those skilled in the art, and are contemplated to be within the scope of the appended claims. For example, hubcaps may be constructed differently than shown in FIGS. 2 and 3. Nevertheless, each hubcap will include some structure which enables its attachment to a wheel or tire rim. This same structure could be used to attach the hubcap to the compartment-defining means described above, i.e., only the basic, minimum components of the mating structure of the wheel or tire rim could be imitated and used in a knapsack in accordance with the invention.

I claim:

1. A knapsack comprising compartment-defining means for defining a selectively accessible compartment, said compartment-defining means comprising a rigid, substantially solid member, a first panel coupled to said rigid member, said first panel being spaced from said rigid member, a circular ring attached to an inner side of said rigid member, and a second panel extending over said ring to thereby define said compartment between said first and second panels, and attachment means for enabling attachment of said compartment-defining means to a wearer of the knapsack.

2. The knapsack of claim 1, wherein said rigid member constitutes a front panel of said knapsack and said first panel constitutes a rear panel of said knapsack adapted to be situated adjacent the wearer's back.

3. The knapsack of claim 1, further comprising a third panel extending between said first panel and said rigid member.

4. The knapsack of claim 1, further comprising access-enabling means arranged in connection with said compartment-defining means for enabling access to said compartment.

5. The knapsack of claim 4, wherein said access-enabling means comprise a zipper.

6. The knapsack of claim 1, wherein said rigid member is a hubcap.

7. The knapsack of claim 1, wherein said attachment means comprise a pair of straps, each of said straps having a first end connected at an upper location to said compartment-defining means and a second end connected at a respective lower location to said compartment-defining means.

8. The knapsack of claim 7, wherein said first and second ends of each of said straps is secured to said rigid member.

9. A knapsack comprising compartment-defining means for defining a selectively accessible compartment, said compartment-defining means comprising a hubcap which constitutes a front, exposed panel of the knapsack, a first panel coupled to and spaced from said hubcap to thereby define said compartment between said hubcap and said first panel, attachment means for enabling attachment of said compartment-defining means to a wearer of the knapsack, wherein said first panel constitutes a rear panel of the knapsack adapted to be situated adjacent the wearer's back and the hubcap is the exterior panel, furthest from the wearer's back.

10. The knapsack of claim 9, wherein said compartment-defining means further comprise a circular ring attached to an inner side of said hubcap, and a second panel extending over said ring to thereby define said compartment between said first and second panels.

11. The knapsack of claim 10, wherein said compartment-defining means further comprise a third panel extending between said hubcap and said first panel.

12. The knapsack of claim 9, further comprising access-enabling means arranged in connection with said compartment-defining means for enabling access to said compartment.

13. The knapsack of claim 12, wherein said access-enabling means comprise a zipper.

14. The knapsack of claim 9, wherein said attachment means comprise a pair of straps, each of said straps having a first end connected at an upper location on said compartment-defining means and a second end connected at a respective lower location on said compartment-defining means.

15. The knapsack of claim 14, wherein said first and second ends of each of said straps is secured to said hubcap.

16. A knapsack comprising at least one panel and a hubcap coupled to one another to define a selectively accessible compartment therebetween, and attachment means for enabling attachment of the coupled at least one panel and hubcap to a wearer of the knapsack wherein said at least one panel constitutes a rear panel of the knapsack adapted to be situated adjacent the wearer's back and the hubcap constitutes a front exterior panel, furthest from the wearer's back.

17. A knapsack comprising compartment-defining means for defining a selectively accessible compartment, said compartment-defining means comprising a rigid, substantially solid member fixed to a panel, wherein said panel constitutes a rear panel of the knapsack adapted to be situated adjacent the wearer's back and said rigid, substantially solid member constitutes a front exterior panel, furthest from the wearer's back and attachment means for enabling attachment of the compartment-defining means to a wearer of the knapsack, said attachment means comprising a pair of straps, each of said straps having a first end connected at an upper location to said compartment-defining means and a second end connected at a lower location to said compartment-defining means, said first and second ends of each of said straps being secured to said rigid member.

18. A knapsack comprising compartment-defining means for defining a selectively accessible compartment, said compartment-defining means comprising a panel and a hubcap fixed to said panel, and attachment means for enabling attachment of said compartment-defining means to a wearer of the knapsack wherein said panel constitutes a rear panel of the knapsack adapted to be situated adjacent the wearer's back and the hubcap constitutes a front exterior panel, furthest from the wearer's back.

* * * * *